US009495889B2

(12) United States Patent
Gryczynski

(10) Patent No.: US 9,495,889 B2
(45) Date of Patent: Nov. 15, 2016

(54) TAMPER EVIDENT SEAL

(71) Applicant: Janusz Gryczynski, Bangor, PA (US)

(72) Inventor: Janusz Gryczynski, Bangor, PA (US)

(73) Assignee: E.J. Brooks Company, Farmington Hills, MI (US)

( * ) Notice: Subject to any disclaimer, the term of this patent is extended or adjusted under 35 U.S.C. 154(b) by 237 days.

(21) Appl. No.: 13/840,111

(22) Filed: Mar. 15, 2013

(65) Prior Publication Data

US 2014/0265369 A1 Sep. 18, 2014

(51) Int. Cl.
*E05B 39/02* (2006.01)
*G09F 3/03* (2006.01)

(52) U.S. Cl.
CPC ..... *G09F 3/0358* (2013.01); *Y10T 292/498* (2015.04)

(58) Field of Classification Search
CPC ..... G09F 3/00
USPC ..... 292/315–321, 307 B, 329
See application file for complete search history.

(56) References Cited

U.S. PATENT DOCUMENTS

| | | | | |
|---|---|---|---|---|
| 2,006,042 | A * | 6/1935 | Dietze | 292/328 |
| 2,020,198 | A * | 11/1935 | Miller | 292/328 |
| 3,980,332 | A * | 9/1976 | King, Sr. | 292/320 |
| 8,485,572 | B2 * | 7/2013 | Nazzari | 292/315 |

* cited by examiner

*Primary Examiner* — Mark Williams
(74) *Attorney, Agent, or Firm* — Bejin Bieneman PLC

(57) ABSTRACT

A tamper evident seal includes a wire hasp, an insert and a body for receiving the insert and the wire hasp. One leg of the wire hasp is received in a channel in the insert through an opening having a length slightly greater than the thickness of the wire hasp. The one leg of the wire hasp must be located in the channel in the insert prior to the insert being located in the body. A coupling structure for coupling the insert in the body includes extension tabs extending from the sides of the insert and located proximal a bottom of the insert and engagement members supported on angularly extending supports located proximal a top end of the insert and extending angularly outwardly upwardly from the sides of the insert and including teeth extending outwardly and for engaging reversely formed teeth (indentations) in the sides of the body for preventing removal of the insert and the wire hasp once they are fully inserted in the body and in the insert, respectively.

17 Claims, 8 Drawing Sheets

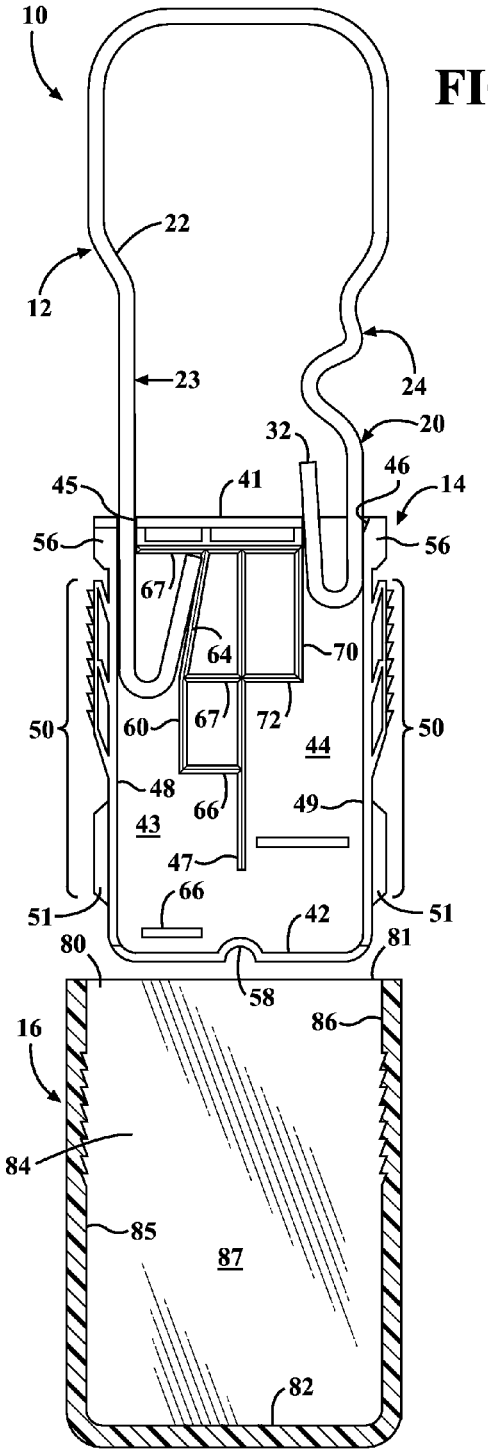
FIG. 3A
FIG. 3B
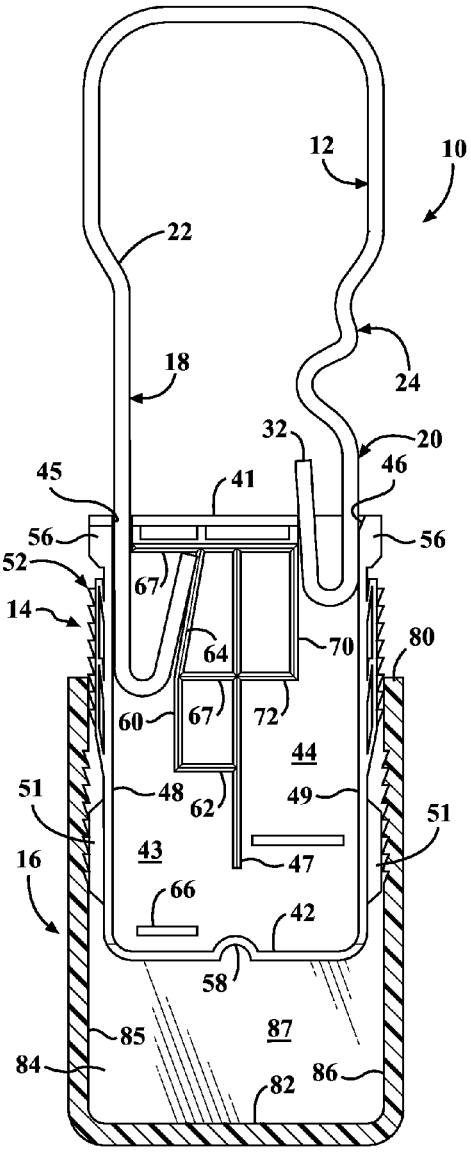

5
10
12
14
16
18
20
22
23
24
30
32
41
42
43
44
45
46
49
51
58
60
62
64
66
67
70
72
87

TAMPER EVIDENT SEAL

BACKGROUND

It is generally known to provide a tamper evident seal such as a molded plastic security seal of a padlock-type. Padlock-type security seals used as a means for sealing all types of housings including electric meters and the like.

Security seals of the padlock type are generally known and are in wide spread use for sealing currency bags, closures, and electric meters and so on. Examples of such seals are shown in the following U.S. Pat. Nos. 3,485,461; 3,373,033; 3,980,332; 4,353,583; 4,278,281; 4,687,240; 4,832,387; 4,893,853; 4,775,175; 5,314,429; and 5,427,423. Such tamper evident seals generally have a plastic body with a pair of passages defined by a body and insert and opening to one end of the body and a shackle or wire hasp formed of a piece of generally U-shaped wire having a pair of legs with bent end portions for being secured within a respective aperture of the plastic body. In the locked position, the legs are bent and permanently received in a pocket in each passage of the plastic body such that if the legs are forcibly removed, it is evident from visual inspection that the security seal is broken or tampered. In the open position, the wire hasp or shackle is completely separate from the body and insert and the legs are not inserted in the passages of the body and insert. In such generally known seals, the relative dimensions of the passages or chambers, the shackle, and the locking grooves are chosen to attempt to limit or prevent picking. However, the known devices have led to other issues and modes of failure such as the use of a corrosive liquid deposited in the passage or chamber to dissolve the metal shackle or wire hasp, or at least one of the legs, such that the seal may be compromised and then put back and appear to still be secure. Such tampering is done also because it appears that seal has merely failed due to environmental factors and not due to intentional tampering. Despite such known devices, there long remains a significant unmet need for an improved tamper evident seal that better guards against non-forcible types of tampering.

DRAWINGS

FIGS. 3A and 3B are exploded, partial, front plan views of the tamper evident seal of the exemplary embodiment of FIG. 1 in first and second assembly steps;

Figure 8:
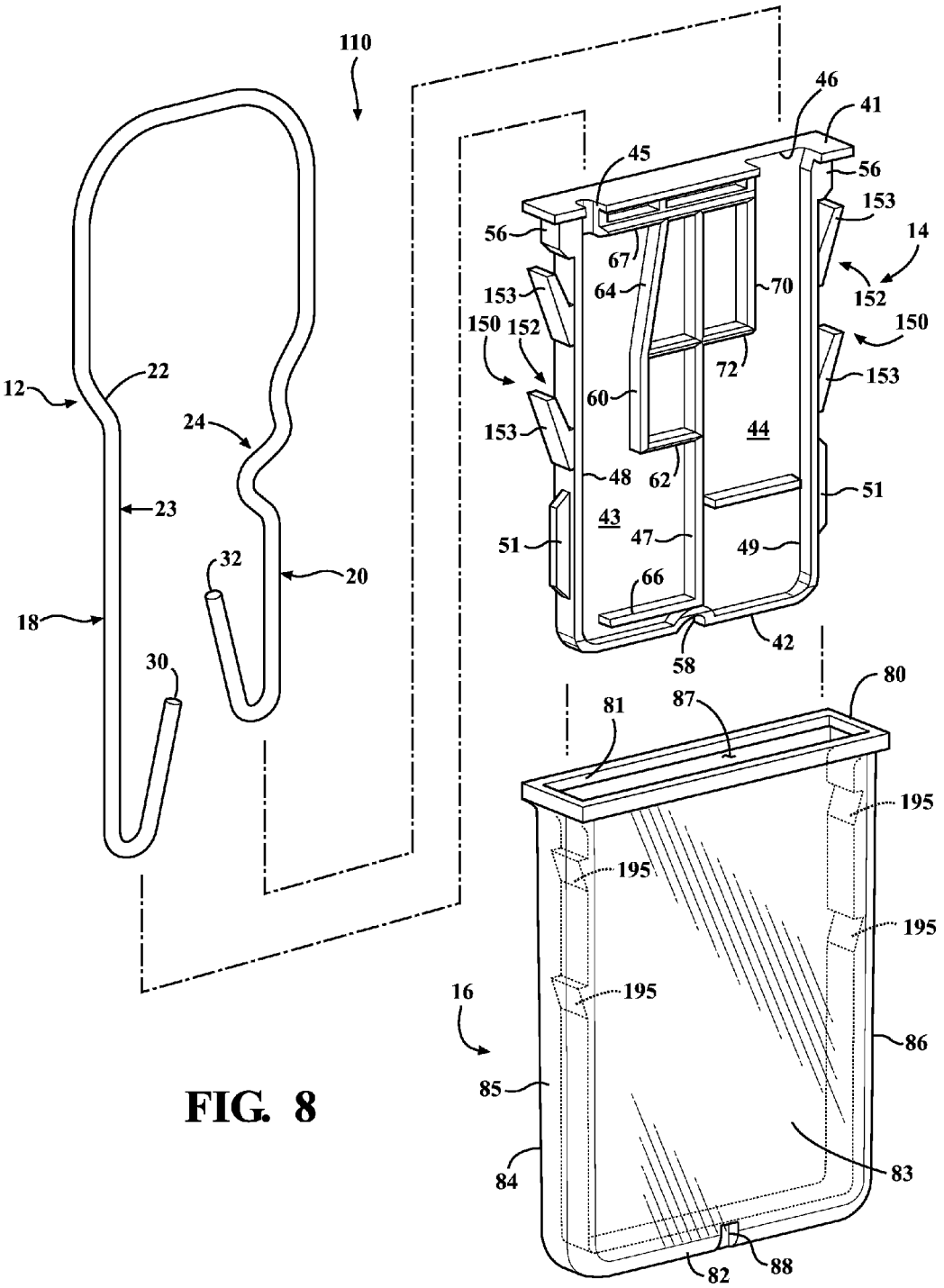
FIG. 8 is an exploded, perspective view of the tamper evident seal of an alternate exemplary embodiment.
Figure 9A:
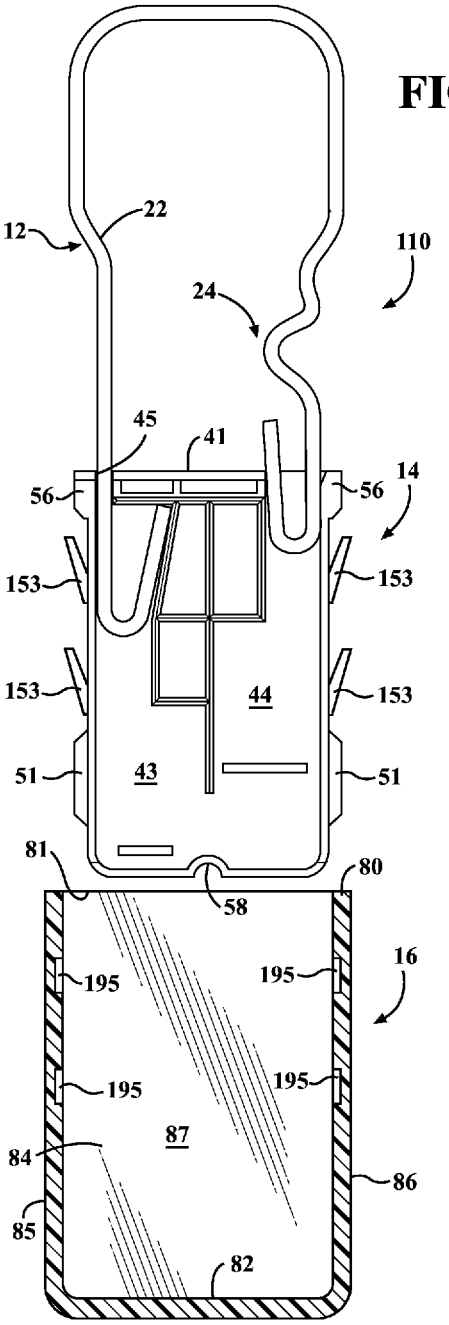
FIGS. 9A and 9B are exploded, partial, front plan views of the tamper evident seal of the exemplary embodiment of FIG. 8 in first and second assembly steps.
Figure 9B:
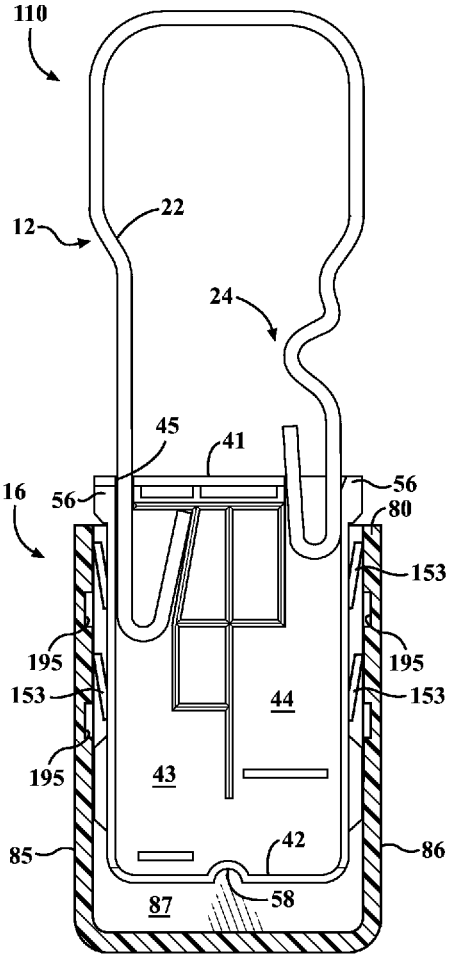
Figure 11:
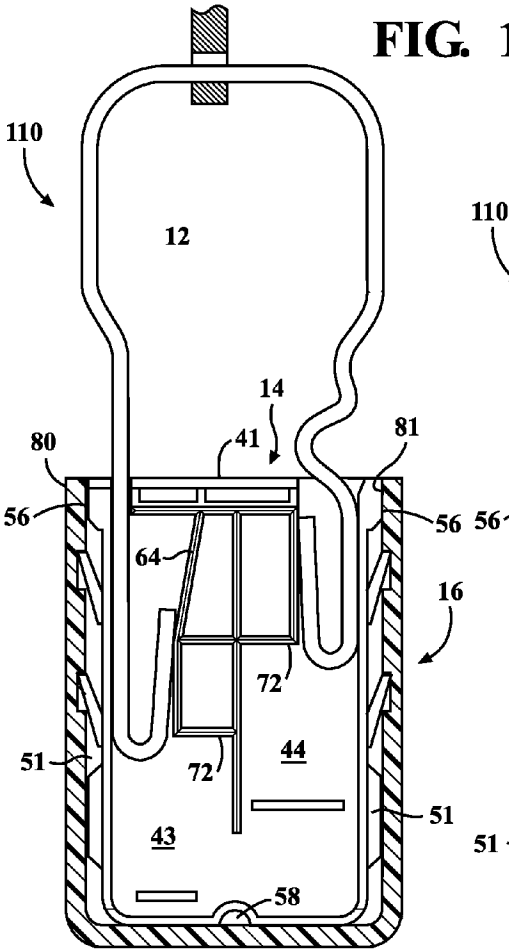
Figure 12:
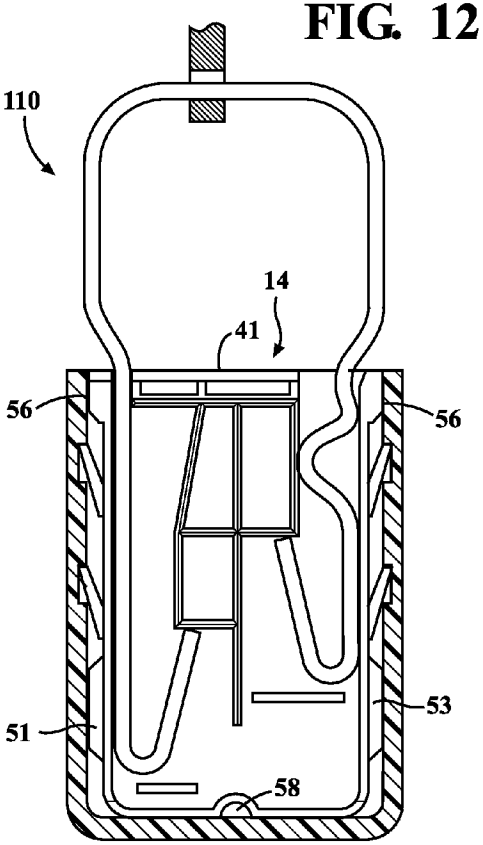

FIG. 11 is a partial, front plan graphic view of the temper evident seal according to the exemplary embodiment of FIG. 8 with the first and second legs of the shackle or wire hasp in a partially inserted position; and FIG. 12 is a partial, front plan graphic view of the temper evident seal according to the exemplary embodiment of FIG. 8 with the first and second legs of the shackle or wire hasp in a fully inserted or locked position in the seal.

DETAILED DESCRIPTION

Referring in general to all of the Figures and in particular to FIGS. 1 through 7, an exemplary embodiment of a tamper evident seal, such as a padlock type seal, according to the present disclosure and teachings is provided for use with any known or appropriate apparatus for which there is a desire for the ability to determine if the apparatus has been tampered or breached. Such tamper evident seals may generally be used to secure a utility meter 1 (e.g., electricity meter, gas meter, water meter and the like) such as those commonly associated with a home or office or other commercial building. The utility meter 1 includes a box or enclosure 2 which may be sealed using a rating three for securing a glass enclosure 4 to the box 2. The ring 3 has ends coupled together by a bolt 5 which may include a passage or hole 6 for securing the ring 3 to the box 2. A tamper evident seal 10 according to the present disclosure is coupled through the passage 6 of the bolt 5 and the ends of the ring 3 to provide a single point of securing the meter 1. Since the utility meter 1 may monitor the usage of a resource which a user normally pays for, it is not uncommon for an owner and/or thief to attempt to tamper with the utility meter to steal the resource without the utility meter registering the stolen resource. Typically, such utility meters are inspected on a semi regular basis during which the tamper evident seal is visually inspected to observe whether the integrity of the seal has been broken. Inspection requires the party responsible for the utility meter to pay the related costs of visual inspection. Accordingly, the more frequent the visual inspection, the greater the cost. The more infrequent the visual inspection, more likely someone is to attempt to breach the tamper evident seal.

Figures 4, 5, 6:
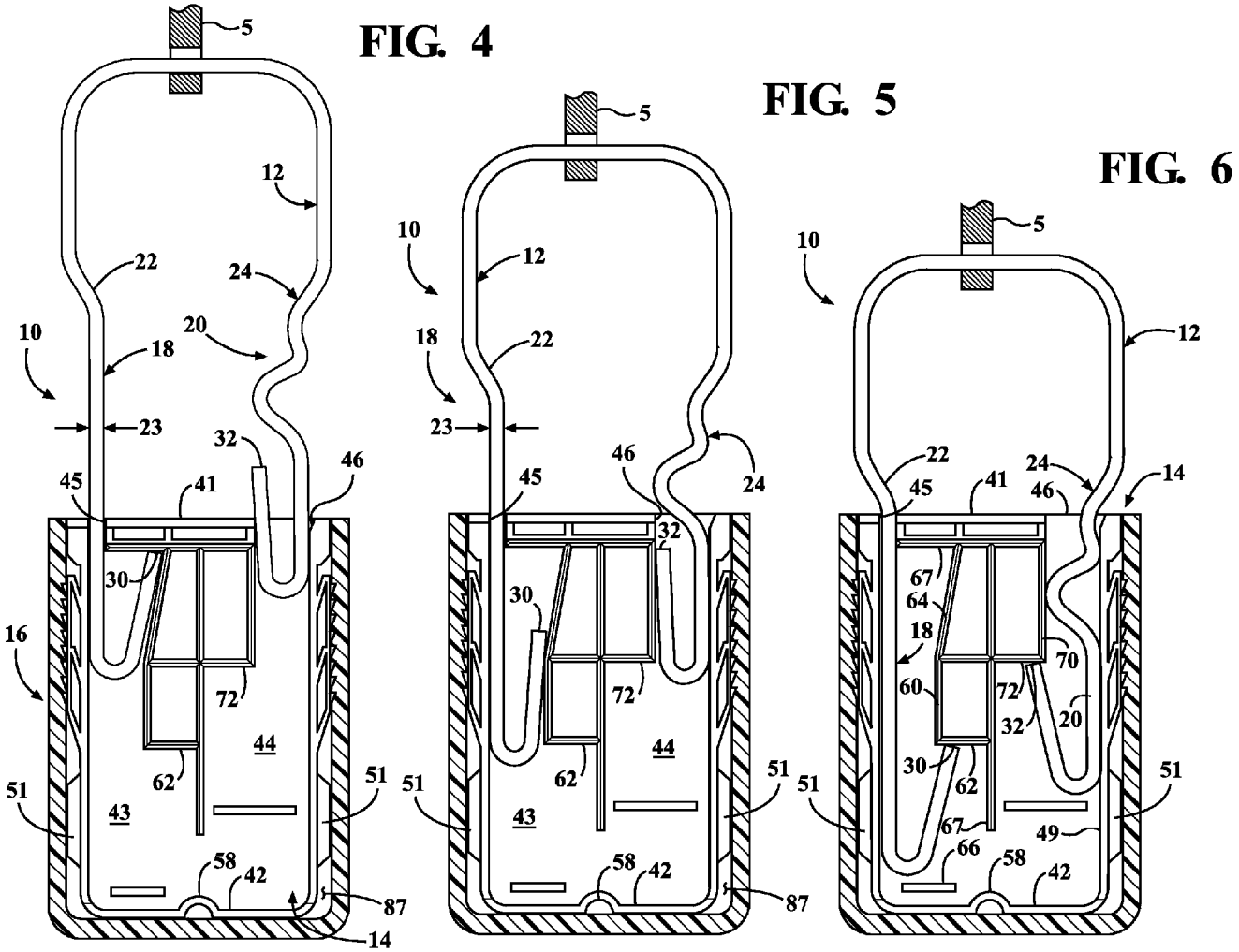
FIG. 4 is a partial, front plan graphic view of the temper evident seal according to the exemplary embodiment of FIG. 1 with the shackle or wire hasp in an first or unlocked position with the first leg of the wire hasp secured in the seal and the second leg of the wire hasp unsecured from the seal.
FIG. 5 is a partial, front plan graphic view of the temper evident seal according to the exemplary embodiment of FIG. 1 with the first and second legs of the shackle or wire hasp in a partially inserted position.
FIG. 6 is a partial, front plan graphic view of the temper evident seal according to the exemplary embodiment of FIG. 1 with the first and second legs of the shackle or wire hasp in a fully inserted or locked position in the seal.

Generally, the tamper evident seal 10 of the present disclosure includes a design similar to the design of the security seal 10 disclosed in U.S. Pat. No. 5,427,423, the entire contents of which is incorporated herein by reference for all purposes. The seal 10 may include a resilient shackle or wire hasp 12, a body or enclosure 16 and an insert or inner member 14. The wire hasp 12 may be formed of a resilient spring wire having a generally U-shape form with a first or long leg 18 and a second or short leg 20. Each of the legs 18 and 20 may have reversely bent end portions 30 and 32, respectively, for securing the legs within the seal 10 as shown in FIGS. 5 and 6. The wire hasp 12 of the exemplary embodiment may preferably be formed of a resilient spring wire. The wire hasp 12 is preferably formed using any known or appropriate manner and material but may be preferably made from a round cross-section galvanized or stainless steel or similar material. In one particular exemplary embodiment, the wire hasp 12 has a generally constant thickness 23 of approximately about 1.32 mm (0.052"). In a further exemplary embodiment, the thickness 23 of the wire hasp 12 may be approximately about 1.19 mm (0.05"). The bent portion 24 of the leg 20 may be formed for limiting the ability of the seal 10 to be picked or tampered. The leg 18 may include a narrowing bent portion 22 and the leg 20 may include a reversely bent portion 24 for limiting the ability of the leg 20 to be picked when it is received in the passage of the insert 14 in the body 16. The bent portion 22 is provided for enlarging and balancing the proportions of the bight portion of the u-shaped wire hasp 12 and, quite uniquely, does not include a reversely bent portion similar to that of the bent portion 24 of the leg 20.

The insert 14 may preferably be made from a plastic material or any other known or appropriate material using any known or appropriate method of manufacturing, but most preferably an injection molding process may be used. The insert 14 may further include a first or top end 41 and a second or bottom end 42. The insert 14 further may include a first channel, passage or chamber 43 and a second channel, passage or chamber 44, each of which extend generally between the top end 41 and the bottom end 42 and may be arranged side-by-side. The chamber 43 may be accessed through a first opening or passage 45 in the top end 41 of the insert 14. Similarly, the chamber 44 may be accessed through a second opening or passage 46 in the top end 41 of the insert 14. The chamber 43 may be further defined by a central rib or extension member 47 which, in at least one exemplary embodiment, generally extends the length between the first end 41 and the second end 42. The chamber 43 may be further defined by the first side or wall 48 which also extends substantially from the first end 41 to the second end 42. Similarly, the chamber 44 may be further defined by the central rib or extension member 47 and by the second side or wall 49 which also extends from the first end 41 to the second end 42.

The chamber 43 may be further defined by a wall 60 which functions to interact with the end 30 of leg 18 as best shown in FIG. 5, to limit the movement of the leg 18 between a first or unlocked position shown in FIGS. 3A and 3B and a second or locked position shown in FIG. 6. The insert 14 may further include a wall 62 located approximately midway in the chamber 43 and extending horizontally from the central rib 47. Wall 62 extends to the wall 60 and the wall 60 extends up from wall 62 to a second wall 63 which extends horizontally to the central rib 47. An angled wall 64 extends from the junction of walls 60 and 63 toward the top end 41 of the insert 14. The wall 62 may further define the chamber 43 and may also function to be engaged by the end 30 of the leg 18 when the wire hasp 12 may be in the locked position of the seal 10 shown in FIG. 6. The chamber 43 may further be defined by a wall 66 extending horizontally from the central rib 47 proximal the end 42 of the insert 14 and by an upper wall 67 extending horizontally from the central rib 47 to the opening or passage 45 in the top and 41.

Figure 1:
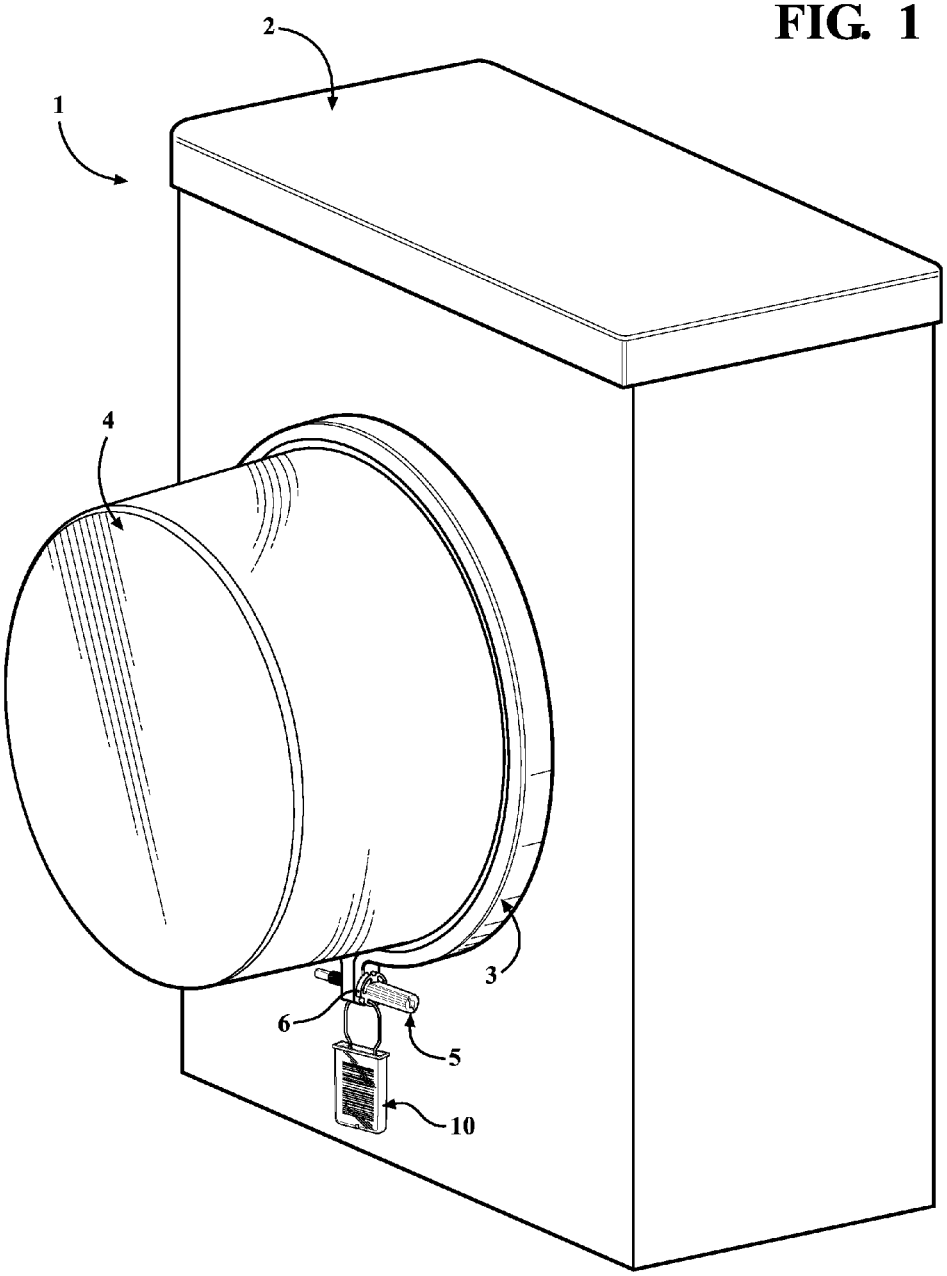
FIG. 1 is a perspective graphic view of an electric meter housing including a tamper evident seal according to an exemplary embodiment of the present disclosure.
Figure 2:
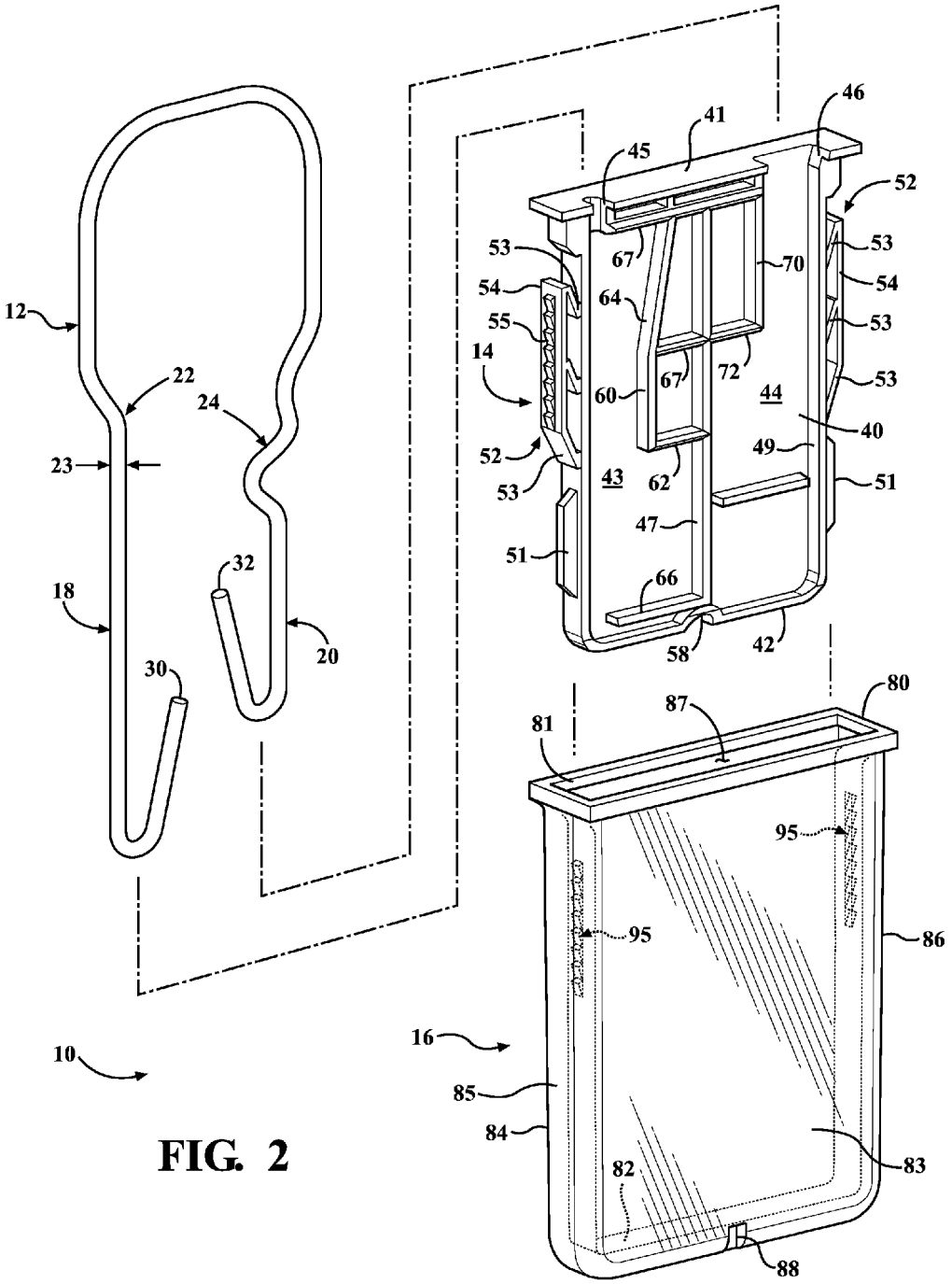
FIG. 2 is an exploded, perspective view of the tamper evident seal of the exemplary embodiment of FIG. 1.

The angled wall 64, the opening 45 and an upper horizontal wall 67 function to secure the leg 18 in the upper portion of chamber 43 in a first or unlocked position as shown in FIGS. 3A, 3B and 4. The width of the opening 45 in the top end 41 is designed and selected to be only sufficiently slightly larger than the thickness 23 of the first leg 18 of the wire hasp 12 such that the wire hasp 12 can move in the opening between the positions noted herein but no more than that. As best shown in FIG. 2, the opening 45 extends to a side or edge of the top end 41 of the insert 14 so that the end 30 of the leg 18 of the wire hasp 12 may be located in the upper area of the passage 43 proximate the angled wall 64 such that the end 30 of the leg 18 abuts or is proximal the wall 67 when the leg 18 is located in the opening 45 as best shown in FIG. 3A. Because the end 30 is reversibly bent to prevent removal of the leg 18 from the passage 43, once the insert 14 is secured in the body 16, the leg 18 is secured within the passage 43 in the first position and the wire hasp 12 is associated with the seal 10 and cannot be disassociated without being broken. Initially, the second leg 20 of the wire hasp 12 may have the reversible bent portion of the end 32 located in the opening 46 during insertion of the insert 14 into the body 16 as shown in FIGS. 3A and 3B. The wire hasp 12 may be sufficiently flexible such that the end 32 may be removed from the opening 46 in the top and 41 of the insert 14 so it may be secured to an object such as when the end 32 may pass through a hole 6 in a bolt 5 and through passages in ends of the ring 3 and may secure the objects together to function as a tamper evident seal 10 which may occur once the seal 10 is fully assembled as shown in FIG. 4.

The insert 14 may include a pair of coupling structures 50. Each coupling structure 50 may preferably be located and extending outwardly of the first and second side walls 48 and 49 of the insert 14. The coupling structure 50 may include an extension tab 51 located proximal the end wall 42 of the insert 14. Each extension tab 51 extends outwardly from the outer surface of the first and second sidewalls 48 and 49, respectively. Each extension tab 51 includes a leading ramp portion proximal the end 42 for guiding the insert 14 during insertion into the body 16 and for stabilizing the insert 14 within the body 16 as best shown in FIGS. 4 through 6. Each coupling structure 50 may further include an engagement member 52 extending from one of the first and second walls 48 and 49, respectively. In one exemplary embodiment the engagement members 52 may be unitarily formed with the insert 14 by injection molding the plastic material of the insert 14. Each coupling structure 50 may further include a pair of shoulders 56 located at the top end 41 of the insert 14 and extending outwardly from each of the first and second sidewalls 48 and 49, respectively in a manner similar to the extension tabs 51.

The engagement member 52 may include a plurality of angled supports 53 extending angularly outwardly and upwardly from the outside surface of each of the first and second walls 48 and 49, respectively, of the insert 14. Each end of each angled support 53 located distally from each of the first and second walls 48 and 49, respectively, may be coupled by a wall 54. Each angled support 53 preferably extends at an acute angle in a direction toward the top end 41 of the insert 14 such that when a force is applied to the wall 54, each support 53 will move, collapse, rotate or pivot toward the respective side wall from which it extends and the wall 54 may be moved toward the respective side wall of the insert, as best shown in FIG. 3B.

The wall 54 of the engagement member 52 may further include a plurality of teeth 55 disposed along a length of the outside surface of the wall 54 and extending in a direction away from the insert 14. The teeth 55 of the wall 54 may be preferably angled or ramped in a direction. The teeth may be for engaging corresponding teeth associated with the body 16 and preventing movement of the insert 14 in at least one direction with respect to the body 16.

The insert 14 may further include a passage 58 centrally located along the outer surface of the bottom end 42 and in communication with the passages 43 and 44 of the insert 14. The passage 58 of the insert 14 is intended to communicate any fluid that becomes located in the passages 43 and 44 of the insert 14 out of the insert 14 and through the body 16 to the external environment of the seal 10 via a passage or hole 88 in the body 16. In some instances, it is known that a fluid, including a corrosive fluid which may corrode and degrade the integrity of the material of the wire hasp 12, may be intentionally located in the passages 43 and 44 of the insert 14.

The body 16 may be a generally rectangularly shaped, five-sided box type structure sized and proportioned for receiving the insert 14 to be located therein. The body 16 may preferably include a first or top end 80 having an opening 81 through which the insert 14 may be inserted or located into the body 16, and a second or bottom end 82 which may be generally closed. Alternatively, the insert 14 may be located in the body 16 in any know or alternative method such as by a two-piece body. The body 16 may further preferably include a front side 83, a backside 84 and first and second sides 85 and 86, respectively. The sides of the body define a passage or chamber 87 in which the insert 14 is received and locked in place. Each of the first and second sides 85 and 86, respectively, of the body 16 may include a row of reversely formed or indented teeth 95 (i.e., indentations) which may be designed to correspond with and receive the teeth 55 of each engagement member 52 of the insert 14 once the insert 14 is located in the passage 87 in the body 16. The indented teeth 95 may be preferably formed in the first and second sides 85 and 86, respectively, of the body 16 during forming of the body, and may also be angled in one direction so that the teeth 55 of the engagement member 52 may only move in one direction with respect to the indented teeth 95 and may not move in an opposite direction. The indented teeth 95 may be preferably formed proximal the top end 80 and spaced a distance from the opening 81 equivalent to the distance between the top and 41 and the engagement members 52 on the insert 14.

Once the insert 14 is located in the passage 87 in the body 16, as shown in FIG. 4 through FIG. 6, any attempt to remove the insert 14 from the body 16 will be resisted by the interaction of the indentations 95 of the body 16 with the teeth 55 of the engagement members 52 as well as by the angled supports 53 of the engagement member 52. Movement of the insert 14 when it is located in the passage 87 in the body 16 is further limited in directions unaligned with the direction of insertion by the shoulders 56 and the extension tabs 51 as best shown in FIGS. 4 through 6. Further, the inner wall of the second or bottom and 82 once the insert 14 is located in the body 16.

Referring in particular to FIG. 4, the wire hasp 12 is shown in the first position in which the leg 18 is secure in the passage 43 of the insert 14 in the body 16 but the second leg 20 has its reversely bent end 32 partially inserted in the passage 44 but the end 32 may be removed from the passage 44 since it does not engage the wall 72 defining the passage 44. Further, the leg 18 is limited from insertion further into the passage 43 by the reversely bent end portion 30 of the leg 18 which helps to prevent the leg 18 from being unintentionally inserted further in the passage 43. Similarly, the reversely bent end 32 of the leg 20 limits the movement of the wire hasp 12 into the passage 44 to prevent an unintended insertion of the leg 20 into the seal 10. With the end 32 of the leg 20 removed from the passage 44 the seal 10 may be applied to an object which is to be secured with the seal 10. It should be noted that it is possible for a user to remove the reversely bent end 32 of the leg 20 from the passage 44 such that the seal 10 can be removed from the hole in the object 5. However, once the wire hasp 12 is fully inserted in the seal 10, it can no longer be removed from the object 5 without evidencing that the seal 10 has been broken.

Once the seal 10 has been passed through the hole in the object 5 and the user intends to fully engage the tamper evident seal 10, force is applied to the wire hasp 12 and the body 16 to cause the ends 30 and 32 of the wire hasp 12 to progress toward the end 42 of the insert 14 as best shown in FIG. 5. A sufficient force is required to overcome the inherent forces of the reversely bent ends 30 and 32 of the wire hasp 12. The ends 30 and 32 of the legs 18 and 20, respectively, continue to travel through the channels or passages 43 and 44, respectively, toward the end 42 of the insert 14 until the ends 30 and 32 pass the bottom ends of the walls 60 and 70, respectively, to achieve the third or engaged position of the tamper evident seal 10, as best shown in FIG. 6. At this point, the ends 30 and 32 return to their naturally occurring or unforced positions under the inherent force of the material of the wire hasp 12 such that the end 30 of the leg 18 is aligned with and is proximal or abuts the wall 62 and the end 32 of the leg 20 is aligned with and is proximal or abuts the wall 72 and the wire hasp 12 can no longer be removed from the insert 14 without destroying some part of the pieces which it make up the seal 10.

Figure 7:
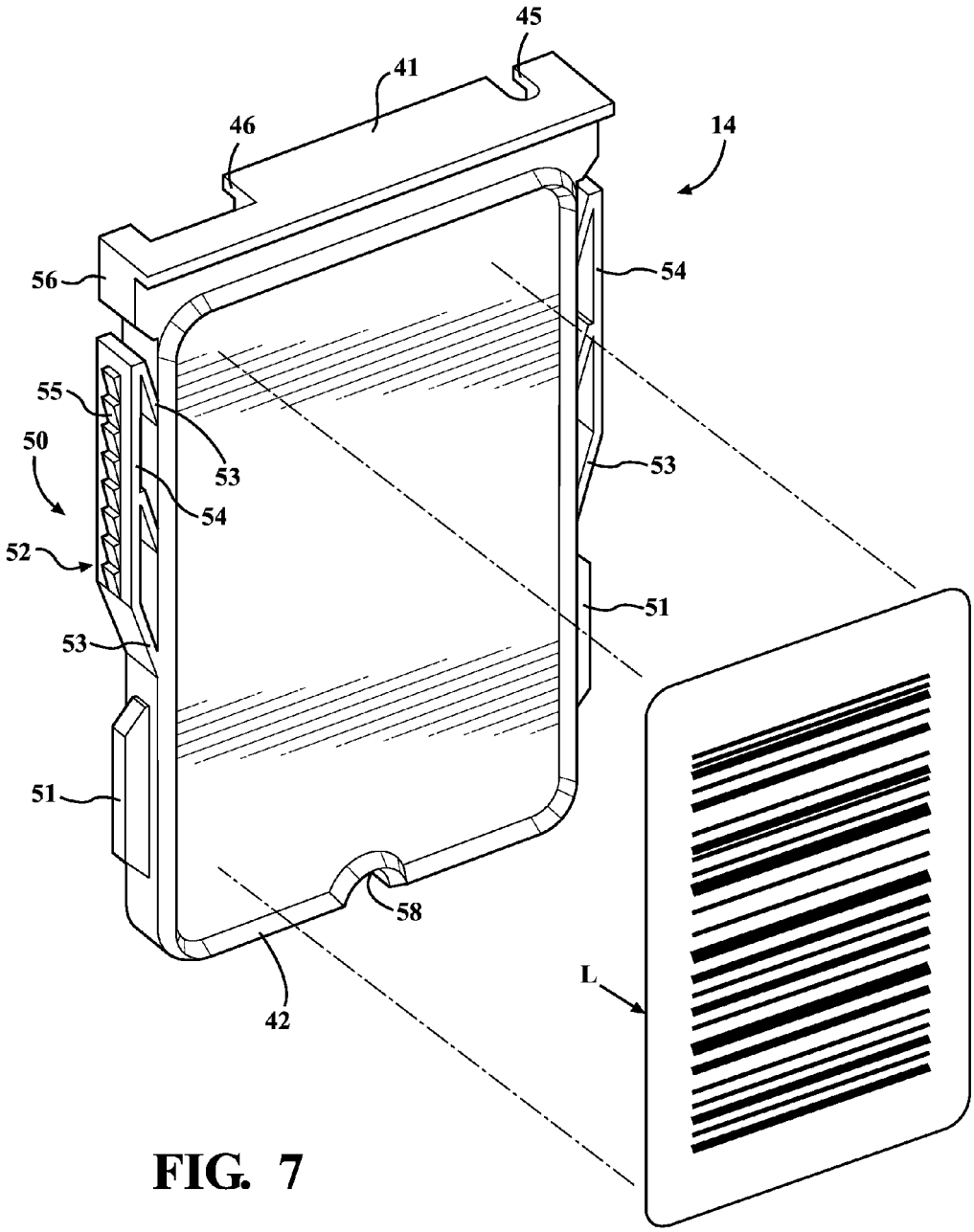
FIG. 7 is a partial, perspective view of an insert of the tamper evident seal of the exemplary embodiment of FIG. 1.

Referring particularly to FIG. 7, the back side of the insert 14 is shown and may include a generally flat and planar surface for receiving a label L that may include any written material, such as the barcode as shown. It should be appreciated that in order for the label L to be seen, it will be necessary for the body 16 to be made from a clear or transparent material. In one particularly exemplary embodiment, the body 16 may be made from a clear acrylate polymer material.

Referring now in particular to the exemplary embodiment of FIGS. 8 through 12, there is disclosed a tamper evident seal 110 including a wire hasp 12, an insert 14 and a body 16 wherein many aspects may be similar to the tamper evident seal 10 of the previous exemplary embodiment. The tamper evident seal 110 includes many unchanged parts from the exemplary embodiment of the tamper evident seal 10 and they are labeled the same in the exemplary embodiment of tamper evident seal 110 in FIGS. 8 through 12. The tamper evident seal 110 includes an alternative design for the coupling structure 150 as compared to the coupling structure 50 of the tamper evident seal 10.

Figure 10:
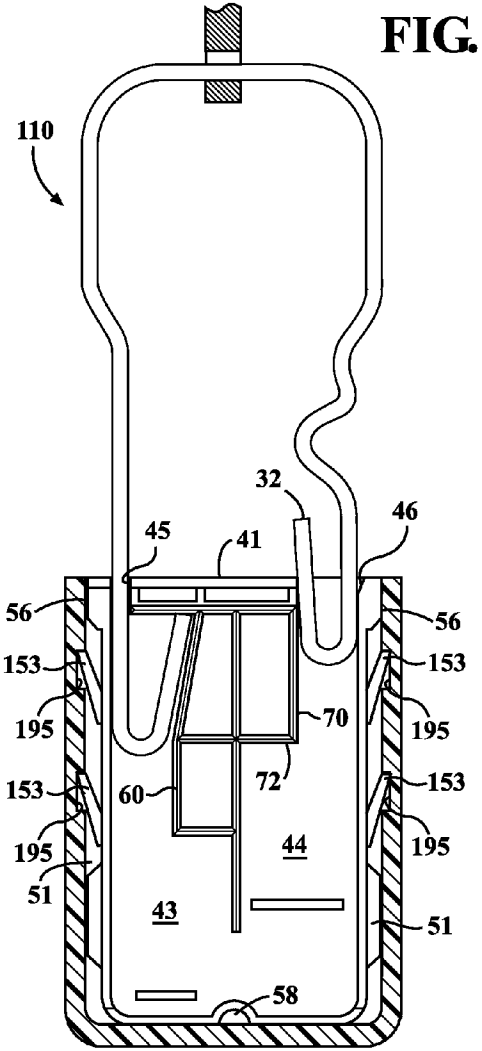
FIG. 10 is a partial, front plan graphic view of the temper evident seal according to the exemplary embodiment of FIG. 8 with the shackle or wire hasp in an first or unlocked position with the first leg of the wire hasp secured in the seal and the second leg of the wire hasp unsecured from the seal.

The tamper evident seal 110 includes a coupling structure 150 including an extension members 51 and engagement members 152, wherein each of the engagement members 152 include at least two angled supports 153 extending angularly outwardly and upwardly from the outside surface of each of the first and second walls 48 and 49, respectively, of the insert 14. Each end of each angled support 153 is located distal from each of the first and second walls 48 and 49, respectively, and may be no longer coupled by a wall as in the exemplary embodiment of the tamper evident seal 10. Each angled support 153 preferably extends at an acute angle in a direction toward the top and 41 of the insert 14 such that when a force is applied to attempt to remove the insert 14 from the body 16, each support 153 will resist such movement's because it engages a slot or reversely angled to 195 on the inner surface of each of the first and second walls 48 and 49, respectively of the insert 14 as best shown in FIGS. 10 through 12.

After having read the above regarding the tamper evident seal 10 of the exemplary embodiments as shown, it should be understood that it is possible to design the tamper evident seal 10 to modify the chambers 43 and 44 of the insert 14 in any combination in an alternative embodiment of the tamper evident seal 10. Accordingly, it is possible for a seal 10 to include the design of the chamber 43 of the insert 14 four capturing both the leg 18 and the leg 20 of the wire hasp 12. Of course, in this embodiment the leg 20 of the wire hasp 12 will be modified to a design similar to the leg 18 of the wire hasp 12 and the method of assembling the wire hasp 12, the insert 14 in the body 16 will necessarily be modified such that the first and second legs 18 and 20, respectively, of the wire hasp 12 are both first located in the chambers 43 and 44, respectively, of the insert 14 and then the insert 14 will be located in the body 16 two secure the tamper evident seal 10. In this alternate embodiment, the passage 44 is modified to have a design similar to the passage 43 shown in FIGS. 4 through 6 such that the opening 46 at the top and 41 of the insert 14 will now have a witness similar, if not identical, to the width of the opening 45 at the top and 41 of the passage 43 of the insert 14 and which is only slightly bigger than the thickness 23 of the wire hasp 12. In this alternate embodiment, it is believed that it will be possible, if not preferred, for the leg 18 in the leg 20 of the wire hasp 12 to have the same length.

Any numerical values recited herein or in the figures are intended to include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the invention of a range in terms of at "'x' parts by weight of the resulting polymeric blend composition" also contemplates a teaching of ranges of same recited amount of "x" in percent by weight of the resulting polymeric blend composition."

Unless expressly stated, all ranges are intended to include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The use of the term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

The disclosure of "a" or "one" to describe an element, ingredient, component or step is not intended to foreclose additional elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps.

It is understood that the present description is intended to be illustrative and not restrictive. Many embodiments as well as many applications besides the examples provided will be apparent to those of skill in the art upon understanding the present disclosure. The scope of the claimed invention should, therefore, not be determined with limiting reference to the description, but should instead be determined with reference to the appended claims, along with the full scope of equivalents to which such claims are entitled. Any disclosure of an article or reference, including patent applications and publications, is incorporated by reference herein for all purposes. Any omission in the following claims of any aspect of subject matter disclosed herein is not a disclaimer of such subject matter.

I claim:

1. A tamper evident seal comprising:

a. a body having a chamber having a first end and a second end wherein the first end is open, the first chamber having a length extending in a first direction;

b. an insert located and sealed in the chamber, the insert having a first channel and a second channel, the insert further having a first end and a second end and wherein the first and second channels extend from the first end of the insert, and further wherein the first channel has an opening extending through the first end of the insert, the opening of the first channel having a length; and c. a wire hasp having first and second legs, the first leg for being located and being locked in the first channel and the second leg for insertion and being locked in the second channel;

d. wherein the first leg of the wire hasp has a thickness that is slightly less than length of the opening of the first channel such that a liquid is significantly impeded from being able to pass into the first chamber;

e. wherein insert includes an angled wall between the first chamber and the second chamber and tapering into the first chamber in a direction away from the first end of the insert for receiving the first leg of the wire hasp as the wire hasp is moved relative to the insert from an unlocked position to a locked position; and f. wherein the insert includes a second wall extending transverse relative to the angled wall defining a chamber receiving the first end of the wire hasp in the locked position.

2. The tamper evident seal of claim 1 wherein each of the first and second legs of the wire hasp each has a reversely bent end portion for engaging a portion of the insert to prevent removal of the wire hasp from the body once the legs have been fully inserted therein.

3. The tamper evident seal of claim 1 wherein the insert is sonically welded and sealed to the body.

4. The tamper evident seal of claim 1 further comprising a passage having a first end located proximal the second end of the chamber and in communication with the chamber and a second end in communication with the atmosphere external of the tamper evident seal.

5. The tamper evident seal of claim 1 wherein each of the first and second legs of the wire hasp each has a reversely bent end portion for engaging a portion of the insert to prevent removal of the wire hasp from the body once the legs have been fully inserted therein and wherein at least one of the reversely bent ends of one of the first and second legs is located in one of the first and second channels of the insert prior to the insert being located in the body.

6. The tamper evident seal of claim 1 wherein the insert is disposed between the wire hasp and the body.

7. The tamper evident seal of claim 1 wherein the second wall is parallel to the first end of the insert.

8. The tamper evident seal of claim 1 wherein the insert includes a third wall extending from the angled wall to the second wall, the third wall being perpendicular to the second wall.

9. The tamper evident seal of claim 1 wherein the second channel has a second opening extending through the first end of the insert, the first leg of the wire hasp extending through the opening into the first channel, the second leg of the wire hasp extending through the second opening into the second channel, the wire hasp being moveable relative to the insert from an unlocked position to a locked position, and the wire hasp being flexible such that an end of the second leg of the wire hasp may be removed from the second channel before the wire hasp is moved to the locked position.

10. A tamper evident seal comprising:

a. a body having a chamber having a first end and a second end wherein the first end is open, the first chamber having a length extending in a first direction;

b. an insert located and sealed in the chamber, the insert having a first channel and a second channel, the insert further having a first end and a second end and wherein the first and second channels extend from the first end of the insert, and further wherein the first channel has an opening extending through the first end of the insert, the opening of the first channel having a length; and c. a wire hasp having first and second legs, the first leg for being located and being locked in the first channel and the second leg for insertion and being locked in the second channel;

d. wherein the first leg of the wire hasp has a thickness that is slightly less than length of the opening of the first channel such that a liquid is significantly impeded from being able to pass into the first chamber; and e. wherein the second channel has a second opening extending through the first end of the insert, the first leg of the wire hasp extending through the opening into the first channel, the second leg of the wire hasp extending through the second opening into the second channel, the wire hasp being moveable relative to the insert from an unlocked position to a locked position, and the wire hasp being flexible such that an end of the second leg of the wire hasp may be removed from the second channel before the wire hasp is moved to the locked position.

11. The tamper evident seal of claim 10 wherein each of the first and second legs of the wire hasp each has a reversely bent end portion for engaging a portion of the insert to prevent removal of the wire hasp from the body once the legs have been fully inserted therein.

12. The tamper evident seal of claim 10 wherein the insert is sonically welded and sealed to the body.

13. The tamper evident seal of claim 10 further comprising a passage having a first end located proximal the second end of the chamber and in communication with the chamber and a second end in communication with the atmosphere external of the tamper evident seal.

14. The tamper evident seal of claim 10 further comprising a coupling structure having a first portion coupled with the insert and a second portion formed in the body and wherein the first and second portions of the coupling structure interact to prevent removal of the insert once the insert and wire hasp have been located in the body.

15. The tamper evident seal of claim 10 wherein the insert is disposed between the wire hasp and the body.

16. The tamper evident seal of claim 10 wherein insert includes an angled wall between the first chamber and the second chamber and tapering into the first chamber in a direction away from the first end of the insert for receiving the first leg of the wire hasp as the wire hasp is moved relative to the insert from an unlocked position to a locked position; and wherein the insert includes a second wall extending transverse relative to the angled wall defining a chamber receiving the first end of the wire hasp in the locked position; and wherein the second wall is parallel to the first end of the insert.

17. The tamper evident seal of claim 10 wherein insert includes an angled wall between the first chamber and the second chamber and tapering into the first chamber in a direction away from the first end of the insert for receiving the first leg of the wire hasp as the wire hasp is moved relative to the insert from an unlocked position to a locked position; and wherein the insert includes a second wall extending transverse relative to the angled wall defining a chamber receiving the first end of the wire hasp in the locked position; and wherein the insert includes a third wall extending from the angled wall to the second wall, the third wall being perpendicular to the second wall.

* * * * *